United States Patent [19]

Dunbar et al.

[11] 4,077,153

[45] * Mar. 7, 1978

[54] CHILD'S PLAY BLOCK WITH CARD-RETAINING TANGS

[75] Inventors: George W. Dunbar, Nashville, Tenn.; Jerrold J. Krumholz, West Orange, N.J.

[73] Assignee: Kusan, Inc., Nashville, Tenn.

[ * ] Notice: The portion of the term of this patent subsequent to May 7, 1993, has been disclaimed.

[21] Appl. No.: 380,610

[22] Filed: Jul. 19, 1973

[51] Int. Cl.[2] ..... A63H 33/04

[52] U.S. Cl. ..... 46/24; 35/69

[58] Field of Search ..... 46/16, 17, 24, 25, 26; 40/152, 154, 156; 35/69, 70, 71, 72, 73; 52/79, 609; D34/15 FF, 15 GG

[56] References Cited

U.S. PATENT DOCUMENTS

| | | | |
|---|---|---|---|
| D. 155,329 | 9/1949 | Bindman | D34/15 FF |
| 1,201,710 | 10/1916 | Finch | 46/26 |
| 1,377,261 | 5/1921 | McLain et al. | 35/71 |
| 1,394,620 | 10/1921 | Haupt | 35/71 |
| 1,428,456 | 9/1922 | Stranders | 35/71 |
| 1,470,866 | 10/1923 | Newhouse | 40/156 |
| 1,904,318 | 4/1933 | Lehere | 40/154 |
| 2,602,254 | 7/1952 | Diekmann | 40/152 |
| 2,807,110 | 9/1957 | Buedingen | 40/156 |
| 3,310,906 | 3/1967 | Glukes | 46/25 |
| 3,645,025 | 2/1972 | Giesecke | 40/152 |

FOREIGN PATENT DOCUMENTS

| | | | |
|---|---|---|---|
| 229,861 | 8/1969 | Australia | 46/25 |
| 1,248,044 | 10/1960 | France | 46/25 |

*Primary Examiner*—Richard T. Stouffer

[57] ABSTRACT

A child's play block having a continuous periphery of material width with a central strengthening web and card retaining tangs adjacent thereto for the reception of picture card inserts which are color coded to the color of the block.

2 Claims, 5 Drawing Figures

FIG. 1
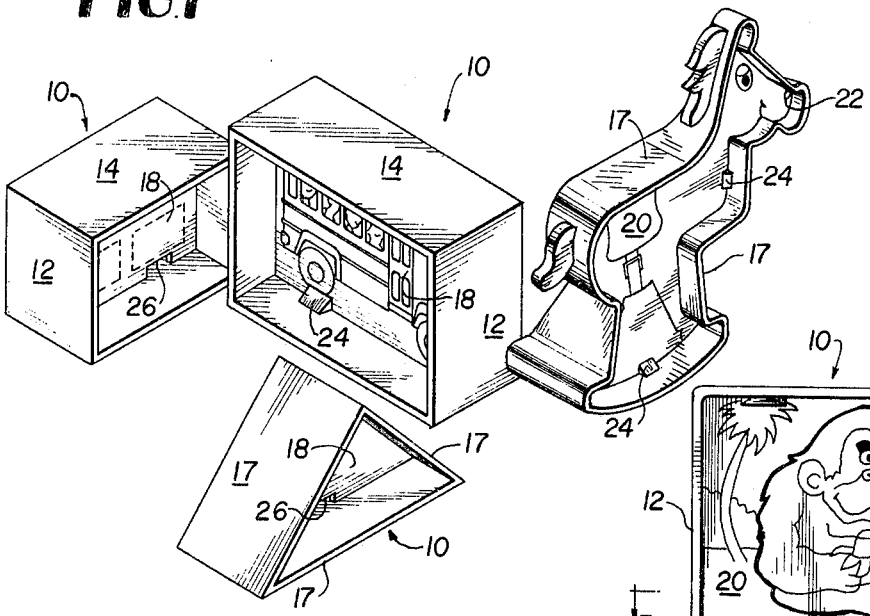
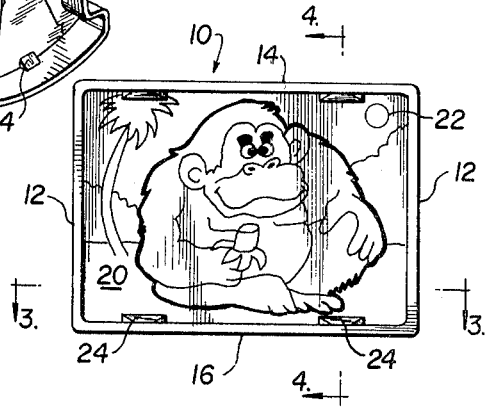
FIG. 2
FIG. 3
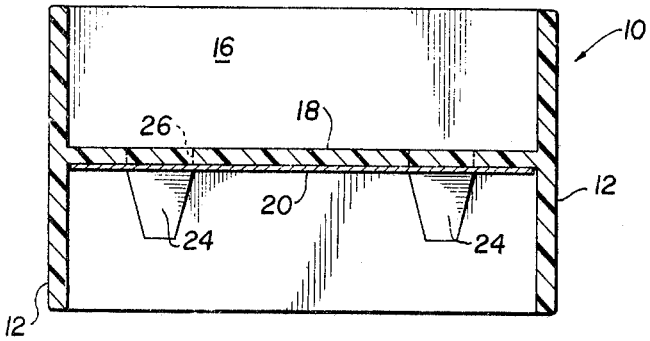
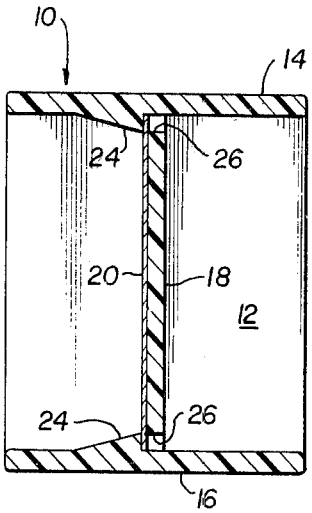
FIG. 4
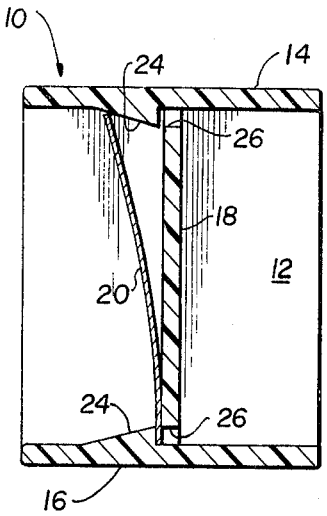
FIG. 5

CHILD'S PLAY BLOCK WITH CARD-RETAINING TANGS

This invention relates generally to a child's play block and more particularly to a strong, rigid block of novel structure in various shapes which may be individual playpieces or used in groups so that a child may construct buildings, play situations, etc. and enhance their attractiveness and play benefit by the use of snap-in cards depicting various child activities, room interiors, vehicles, animals, etc.

Blocks for children have long been known in the art and conventionally take the form of solid cubes of different colors bearing various types of ornamentation and letters so that play therewith by a child is severely limited in scope. Other more modern blocks are also known in the art but, insofar as is known, these require skills beyond the ordinary child's capacity to assemble them in a meaningful fashion or require additional small cooperating pieces such as furniture, etc. which are easily misplaced or lost.

Accordingly the main object of the present invention is to provide a novel and improved play block for young children having only the skills of the 2–5 age group, which may be used individually or with others to build cities, castles, forts or anything they can imagine.

An important object of the present invention is to provide a novel play block for children which is strong and rigid and with rounded corners so as to be safe for use by young children.

Another important object of the present invention is to provide a novel play block for children which may be formed of different attractive colors and with means for retaining card inserts bearing pictures of interest to young children such as people, animals, vehicles, shops, school rooms, plants, landscapes, etc.

A further important object of the present invention is to provide a novel play block for young children which may be formed of different colors and shapes, and with means to retain picture cards which are color coded to the color of the block.

A still further important object of the present invention is to provide a novel play block for children which is box-like in construction but open and with an intermediate or central strengthening partition or web so as to be extremely attractive in appearance and very easy for young, small hands to pick up.

Other objects and advantages of the invention will become apparent during the course of the following description.

In the drawings, we have shown one embodiment of the invention. In this showing:

FIG. 1 is a perspective group view of the invention illustrating some of the shapes and relative sizes in which the block may be molded;

FIG. 2 is a front elevational view of a rectangular block with a conforming pictorial card insert snapped into place against the central web;

FIG. 3 is a horizontal, sectional view thereof to an enlarged scale, taken on the line 3—3 of FIG. 2;

FIG. 4 is a vertical sectional view thereof, taken on the line 4—4 of FIG. 2; and FIG. 5 is a similar view thereof but showing the pictorial card insert only partially snapped into position against the intermediate web and behind the retaining tabs.

Referring to the drawings, numeral 10 designates the novel block comprising the present invention as a whole which comprises an open box-like structure having a continuous periphery with rounded corners and edges defining ends 12, a top 14 and a bottom 16 or all sides 17. The block need not be a geometric figure but may have a periphery of flat or curved sides 17 defining the outline of a familiar figure such as an animal, a person, a toy, etc. (FIG. 1). Similarly, a rectangular block may employ a pictorial insert card 20 depicting the same (FIG. 1). The block is formed of high impact styrene and is provided with an intermediate and substantially centrally positioned strengthening web 18 which may be solid as shown or in lattice (dotted lines) against which pictorial cards 20 are positioned.

A plurality of the pictorial cards 20 depicting various scenes, etc. as hereinbefore is described are furnished with the variously colored blocks — one for each block — and each is provided in its upper right hand corner with variously colored dots 22 to indicate to the child that a red dotted card belongs with a red block, a blue dotted card with a blue block, etc.

The pictorial cards 20 are retained in position against the intermediate block web 18 by a pair of spaced tangs 24 just spaced from the web in the top 14 and the bottom 16 which tangs are readily molded therein by means of molding apertures 26 in the web 18 which do not detract from the strength or attractive appearance of the web. In the case of a triangular block, one tang 24 is formed in each of the sides and in irregular shapes such as the horse of FIG. 1, the tangs are placed as needed.

As shown in FIG. 5, the lower edge of a pictorial card insert 20 has been snapped behind the lower tangs 24 against the web 18 and when the upper part of the card is snapped behind the upper tangs, it takes the position shown in FIG. 4.

A set of the novel blocks 10 and pictorial cards 20 includes cardboard bases (not shown) which are printed so as to give children a ground plan or positioning guide for building a zoo, a shopping village, an airport, a school, etc. so that the children are encouraged in the use of their imagination in constructing the various buildings.

It will not be apparent that the novel play block for children comprising the present invention is a safe strong toy which teaches color consciousness in young children in the color coding of the pictorial insert cards with the differently colored blocks, and also develops mechanical skills in using the differently shaped and sized blocks and in playing with them individually.

It is to be understood that the form of our invention herewith shown and described is to be taken as a preferred example of the same and that various changes in the shape, size and arrangement of parts may be resorted to without departure from the spirit of the invention or the scope of the subjoined claims.

What is claimed is:

1. A play building block of such dimensions as to be readily picked up by a young child's hand comprising a unitary member having the shape of joined, oppositely disposed boxes of similar size and depth and having a common bottom, corresponding sides and open tops, the corresponding sides of said joined boxes forming substantially continuous planar surfaces, the bottom, sides and the top of each box defining the interior of that box therebetween, said block having tangs rigidly mounted on the interior surfaces of opposed sides of at least one of said boxes and just spaced from the bottom thereof to retain a pictorial insert card against said bottom.

2. A play building block of such dimensions as to be readily picked up by a young child's hands comprising a unitary member having the shape of joined, oppositely disposed boxes of similar size and depth and having a common bottom, corresponding sides and open tops, the corresponding sides of said joined boxes forming substantially continuous planar surfaces, the bottom, sides and the top of each box defining the interior of that box therebetween, said boxes being triangular and having a tang rigidly mounted on the interior surface of at least one of the sides of at least one of said boxes and just spaced from the bottom thereof to retain a pictorial insert card against said bottom.

* * * * *